US007874401B2

(12) United States Patent
Uhlemann et al.

(10) Patent No.: US 7,874,401 B2
(45) Date of Patent: Jan. 25, 2011

(54) EXHAUST MUFFLER FOR EXHAUST SYSTEM

(75) Inventors: Thomas Uhlemann, Stuttgart (DE); Peter Gorke, Stuttgart (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 0 days.

(21) Appl. No.: 12/468,230

(22) Filed: May 19, 2009

(65) Prior Publication Data

US 2009/0301807 A1 Dec. 10, 2009

(30) Foreign Application Priority Data

Jun. 6, 2008 (DE) ..... 10 2008 027 290

(51) Int. Cl.
*F01N 1/02* (2006.01)

(52) U.S. Cl. ..... 181/251; 181/268; 181/275; 181/250

(58) Field of Classification Search ..... 181/250, 181/272, 273, 276, 281, 282, 238, 239, 251, 181/257, 268, 275, 249, 255, 267, 269, 212, 181/227, 228, 266; 60/312
See application file for complete search history.

(56) References Cited

U.S. PATENT DOCUMENTS 4,287,962 A 9/1981 Ingard et al.
4,487,289 A * 12/1984 Kicinski et al. ..... 181/252
4,840,030 A * 6/1989 Ikeda et al. ..... 60/324
4,947,645 A * 8/1990 Pemberton ..... 60/313
5,009,065 A 4/1991 Howe et al.
5,351,481 A * 10/1994 Flugger ..... 60/273
6,470,998 B1 * 10/2002 White ..... 181/243

(Continued)

FOREIGN PATENT DOCUMENTS

DE 1 292 667 4/1969

(Continued)

OTHER PUBLICATIONS

Translation of JP 58-0939208, Translated May 4, 2010 by Akiko Smith, USPTO.*

*Primary Examiner*—Elvin G Enad
*Assistant Examiner*—Jeremy Luks
(74) *Attorney, Agent, or Firm*—McGlew and Tuttle, P.C.

(57) ABSTRACT

An exhaust muffler (1) is provided for an at least partly dual-flow exhaust system of an internal combustion engine, especially of a motor vehicle. The exhaust muffler has a housing (2), which encloses an interior space (3), with two exhaust pipes (6), through which exhaust gas can flow in parallel, and which are each led through the interior space (3), and which have a side opening (8) each within the housing (2). A neck body (9) connects the two side openings (8) of the exhaust pipes (6) in a communicating manner to form a Helmholtz resonator with the interior space (3) of the housing (2), which interior space (3) acts as a resonance volume (12). An embodiment, which has an especially compact design and can be manufactured at a low cost, is obtained when the neck body (9) has two plate-shaped longitudinal walls (11), which are in contact each with the two exhaust pipes (6) and which define a neck volume (10), into which the side openings (8) of the exhaust pipes (6) open, and which is open towards the resonance volume (12).

20 Claims, 6 Drawing Sheets

U.S. PATENT DOCUMENTS

| | | | | |
|---|---|---|---|---|
| 6,889,499 | B2 * | 5/2005 | Bassani | 60/312 |
| 6,912,843 | B2 * | 7/2005 | Hufendiek et al. | 60/282 |
| 2007/0045041 | A1 | 3/2007 | Krueger et al. | |

FOREIGN PATENT DOCUMENTS

| | | | |
|---|---|---|---|
| DE | 27 06 957 | A1 | 8/1978 |
| DE | 28 56 889 | A1 | 11/1980 |
| DE | 102005052619 | A | 5/2007 |
| EP | 15 10 666 | A2 | 3/2005 |
| EP | 1959106 | A | 8/2008 |
| GB | 995 528 | A | 6/1965 |
| JP | 58-0 93 919 | | 6/1983 |
| JP | 58-0 93 920 | A | 6/1983 |

* cited by examiner

EXHAUST MUFFLER FOR EXHAUST SYSTEM

CROSS REFERENCE TO RELATED APPLICATIONS

This application claims the benefit of priority under 35 U.S.C. §119 of German Patent Application DE 10 2008 027 290.6 filed Jun. 6, 2008, the entire contents of which are incorporated herein by reference.

FIELD OF THE INVENTION

The present invention pertains to an exhaust muffler for an at least partly dual-flow exhaust system of an internal combustion engine, especially of a motor vehicle. The present invention pertains, besides, to an exhaust system equipped with such an exhaust muffler.

BACKGROUND OF THE INVENTION

The exhaust gas generated by the internal combustion engine is removed via two separate flows in dual-flow exhaust systems. Such a dual-flow design may be useful, for example, in case of V engines or boxer engines. Common exhaust mufflers may be associated with the two lines of the dual-flow exhaust system, for example, in order to absorb resonances of the pipes. Such an exhaust muffler comprises a housing, which encloses an interior space, as well as two exhaust gas pipes, through which exhaust gas can flow and which are each led through the interior space of the housing. Such an exhaust muffler may, in principle, be designed as a Helmoltz resonator. The interior space of the housing is now used as a resonance volume. To connect this resonance volume to the exhaust pipes, it is possible to provide, for example, a T-shaped neck body, which is connected to the two exhaust pipes via a transverse pipe in a communicating manner and from which a longitudinal pipe extending between the exhaust pipes exits, said longitudinal pipe being open towards the interior space of the housing. A comparatively large space is needed in such a design between the two exhaust pipes in order to make it possible to accommodate the longitudinal pipe of this neck body. Furthermore, connecting the transverse pipe to the two exhaust pipes in a gas-tight manner is often problematic. Furthermore, the manufacture of the T-shaped neck body is comparatively complicated and hence expensive.

SUMMARY OF THE INVENTION

The present invention has the object of providing an improved embodiment for an exhaust muffler of the type mentioned in the introduction or for an exhaust system equipped therewith an improved embodiment, which embodiment is characterized in that the exhaust muffler has a comparatively compact design and can be manufactured at a comparatively low cost, while a sufficient absorbing action shall be able to be achieved at the same time.

According to the invention, an exhaust muffler is provided for an at least partly dual-flow exhaust system of an internal combustion engine, especially of a motor vehicle. The muffler includes a housing, which encloses an interior space, two exhaust pipes, through which exhaust gas can flow in parallel and which are each led through the interior space and which have each a side opening within the housing and a neck body. The neck body connects the two side openings of the exhaust pipes in a communicating manner to form a Helmholtz resonator with the interior space of the housing. The interior space acts as a resonance volume. The neck body has two plate-shaped longitudinal walls, which are each in contact with the two exhaust pipes and which define a neck volume, into which the side openings of the exhaust pipes open, and which is open towards the resonance volume.

The present invention is based on the general idea of forming the neck body by means of two plate-shaped longitudinal walls, which are located at spaced locations from one another and are each in contact with the two exhaust pipes. The neck volume, which is open towards the resonance volume, i.e., towards the interior space of the housing, on the one hand, and into which side openings of the exhaust pipes open, on the other hand, is defined between these longitudinal walls. Due to this design, the neck body has a structure that can be embodied in an extremely simple manner, which can be manufactured at a low cost and which can, besides, also be connected to the exhaust pipes in a gas-tight manner in a comparatively simple manner. For example, only straight weld seams are necessary, which can be prepared comparatively simply with a high quality. Furthermore, the neck body requires only a small space for its installation between the two exhaust pipes, because the two longitudinal walls are directly supported at the exhaust pipes, so that wall sections of the exhaust pipes located between the two longitudinal walls form lateral limitations of the neck volume and hence contribute to the embodiment of the neck body. The neck body being proposed thus makes do with a comparatively short distance between the exhaust pipes to embody a sufficient neck volume for the desired Helmholtz resonator. The exhaust muffler according to the present invention correspondingly can have a comparatively compact design.

Corresponding to an advantageous embodiment, the neck body may, in addition, also have a plate-shaped transverse wall, which defines the neck volume on one side of the side openings, so that the neck volume is open towards the resonance volume on the other side of the side openings only. Due to this mode of construction, the Helmholtz resonator formed has a single neck volume only, as a result of which is can be designed specifically for a certain natural frequency.

Especially advantageous is a variant in which the neck body is formed by a U-shaped sheet metal part, whose legs form the longitudinal walls and whose base, which connects the two legs to one another, forms the transverse wall. This sheet metal part may be formed especially from a single piece of sheet metal. On the whole, an especially inexpensive embodiment is obtained hereby for the neck body and hence for the exhaust muffler.

It is apparent that the above-mentioned features, which will still be explained below, can be applied not only in the particular combination described, but in other combinations or alone as well without going beyond the scope of the present invention.

Preferred exemplary embodiments of the present invention are shown in the drawings and will be explained in more detail in the following description, where the same reference numbers refer to identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
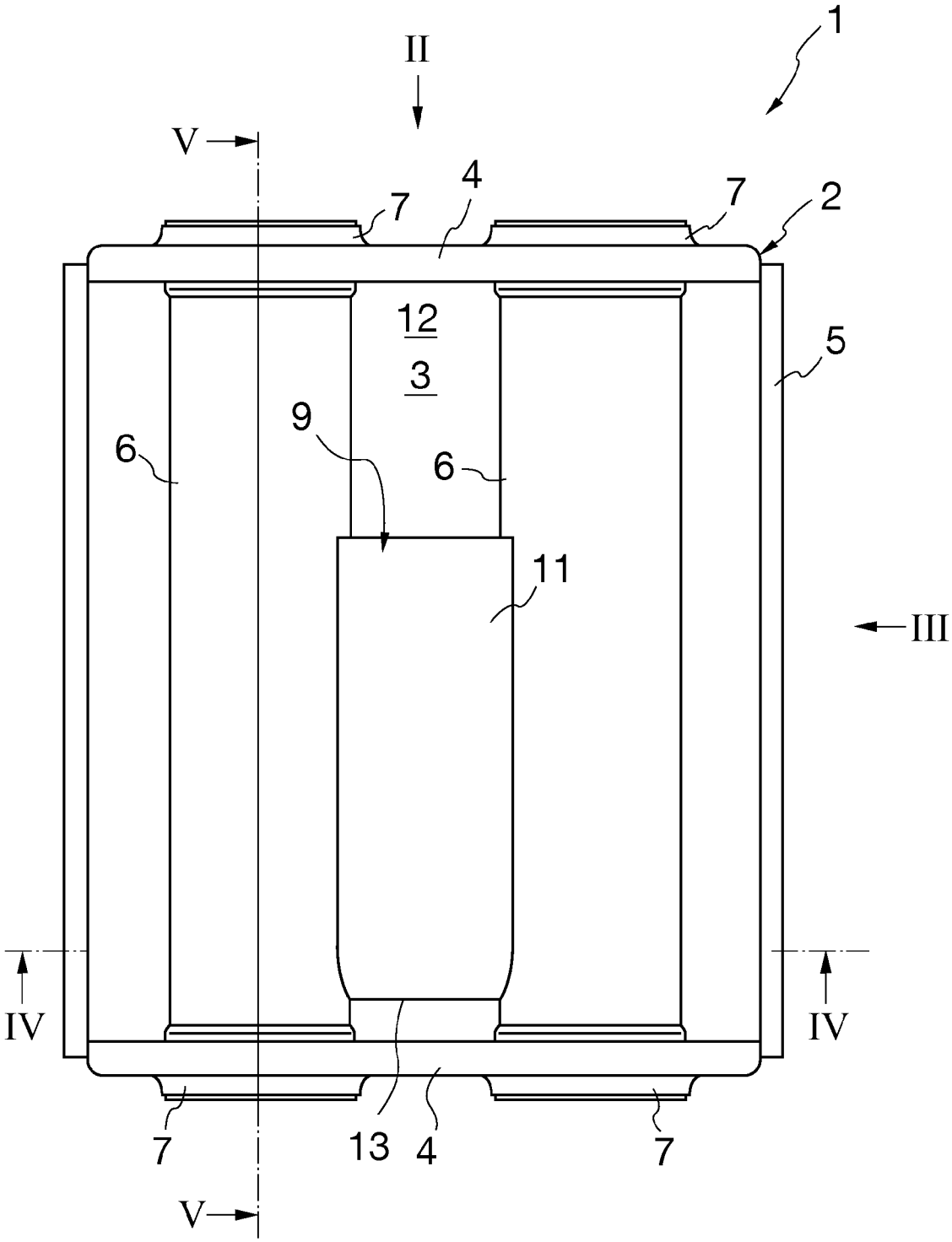
FIG. 1 is a cut-away top view of an exhaust muffler.

Referring to the drawings in particular, FIGS. 1 through 8 show an exhaust muffler 1, which can be used in an at least partly dual-flow exhaust system of an internal combustion engine, which exhaust system is not shown in more detail. The internal combustion engine may be arranged especially in a motor vehicle. The exhaust muffler 1 comprises a housing 2, which encloses an interior space 3. The housing 2 comprises, for example, two bottoms 4 arranged on the front side as well as two half shells 5, which enclose the interior space 3 laterally and into which the bottoms 4 are inserted for longitudinally defining the interior space 3. The half shell 5 facing the viewer is omitted in FIG. 1 in order to offer a view into the interior space 3 of housing 2. Housing 2 has an extremely simple and low-cost design due to the two half shells 5 and the two bottoms 4. However, other modes of construction are, in principle, also conceivable for the housing 2. For example, a one-part tubular body may be used instead of the two half shells 5.

The exhaust muffler 1 has, in addition, exactly two or at least two exhaust pipes 6, through which the exhaust gas of the internal combustion engine can flow in parallel and which are each led through the interior space 3. The exhaust pipes 6 are led specifically through the two bottoms 4. The bottoms 4 have ring-shaped collars 7 for this, into which end sections of the exhaust pipes 6 are inserted. Each exhaust pipe 6 has a side opening 8, recognizable from FIGS. 4, 5 and 8, within the housing 2. These side openings 8 are preferably arranged at the two exhaust pipes 6 such that they face each other. In particular, they are directed flush with one another.

Exhaust muffler 1 contains, further, a neck body 9, which is used to connect the two side openings 8 to the interior space 3 of the housing 2 in a communicating manner, namely, such that a Helmholtz resonator is formed in the process. The interior space 3 of housing 2 is then used as a resonance volume of the Helmholtz resonator, while the neck body 9 encloses a neck volume 10, which defines the neck of the Helmholtz resonator. The neck body 9 has two plate-shaped longitudinal walls 11, which are each in contact with two exhaust pipes 6. The longitudinal walls 11 are located at spaced locations from one another and define the above-mentioned neck volume 10. The longitudinal walls 11 are arranged such that the side openings 8 open between them into the neck volume 10. Furthermore, the two longitudinal walls 11 are open towards the interior space 3, i.e., towards the resonance volume of the Helmholtz resonator, which said volume will hereinafter be designated by 12.

In the example being shown, the neck body 9 is arranged entirely within the housing 2, and it is positioned especially at a spaced location from housing 2. In the embodiment being shown, the neck body 9 has, besides, a plate-shaped transverse wall 13, which likewise forms a limitation of the neck volume 10. The neck volume 10 is correspondingly defined on one side of the side openings 8 by the transverse wall 13 and is open towards the resonance volume 12 on the other side of the side openings 8. The neck volume 10 can be fixed accurately as a result, which simplifies the design of the Helmholtz resonator to a certain natural frequency.

Figure 6:
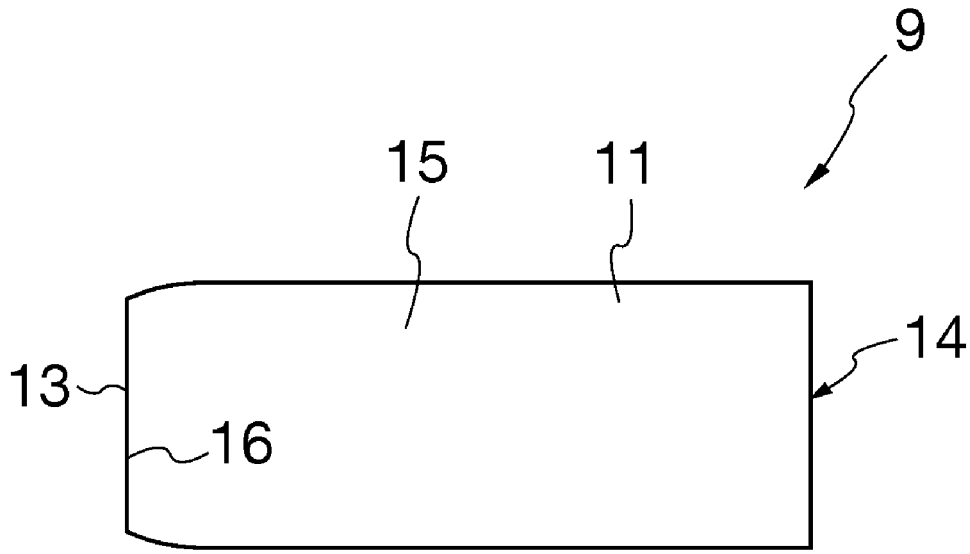
FIG. 6 is a top view of a neck body of the exhaust muffler.
Figure 7:
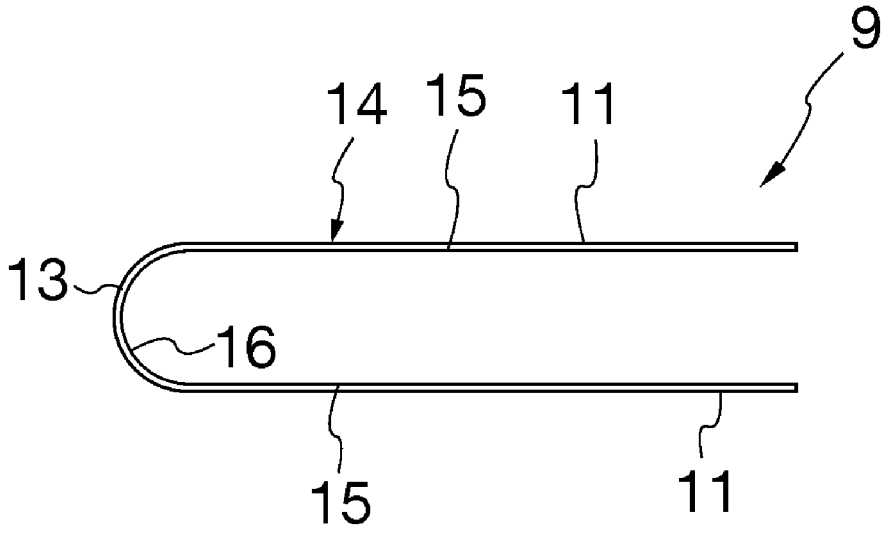
FIG. 7 is a side view of the neck body.

The neck body 9 can be advantageously manufactured corresponding to FIGS. 6 and 7 by means of a U-shaped sheet metal part 14, which may be formed especially from a single piece of sheet metal. Legs 15 of the U-shaped sheet metal part 14 form the longitudinal walls 11, while a base 16 of the U-shaped sheet metal 14, which base connects the two legs 15 to one another, forms the transverse wall.

It proved to be advantageous for designing the Helmholtz resonator to arrange the two side openings 8 in the area of the transverse wall 13. As a result, quasi the entire neck volume 10 is available for generating a resonating air mass.

The transverse wall 13 may also be eliminated in an alternative embodiment, which is not shown here, so that the neck volume 10 is now open towards the resonance volume 12 on both sides of the side openings 8. The neck body 9 now has two mutually opposite openings, with which it communicates with the resonance volume 12 and with the interior space 3. By selecting different distances between these openings and the side openings 8, it is possible, in particular, to design the Helmholtz resonator for two different natural frequencies. This may be advantageous for certain applications.

The side openings 8 are located opposite each other within the neck volume 10 in the embodiment being shown here. As a result, the Helmholtz resonator acts uniformly for both exhaust pipes 6.

The two exhaust pipes 6 are led through the housing 2 in a straight line as well as in parallel to one another in the example being shown. However, other designs with obliquely extending exhaust pipes or with curved exhaust pipes are, in principle, conceivable as well. Furthermore, the exhaust pipes 6 have a constant cross section each between the bottoms 4 in the example, which facilitates especially the arrangement of the neck body 9. However, other designs are conceivable here as well.

The longitudinal walls 11 and the transverse wall 13, which is possibly present, are each of a "plate-shaped" design. This means in this connection an essentially flat shape of the walls, i.e., the particular wall has considerably larger dimensions in the longitudinal direction and in the direction of the width than in the direction of the thickness. Furthermore, the longitudinal walls 11 are flat here. Furthermore, the contact areas, in which the longitudinal walls 11 make contact with the exhaust pipes 6, are straight here, which simplifies the gas-tight connection between the longitudinal walls 11 and the exhaust pipes 6. For example, the neck body 9 can be welded or soldered to the exhaust pipes 6. The bottoms 4 may likewise be welded or soldered to the half shells 5. The two half shells 5 may also be fastened to one another by welded connections or soldered connections. The exhaust pipes 6 may also be soldered or welded at their ends to the collar 7 of the bottoms 4.

Figure 2:
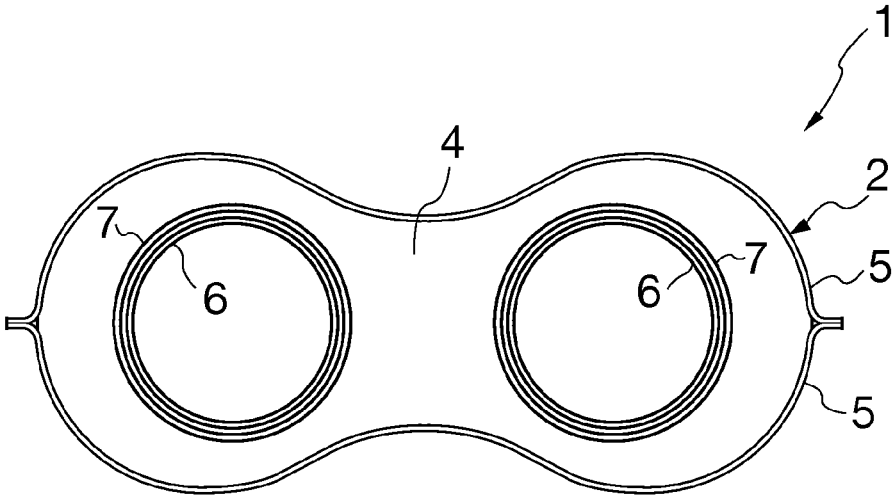
FIG. 2 is a front view of the exhaust muffler corresponding to a direction of view II in FIG. 1.
Figure 3:
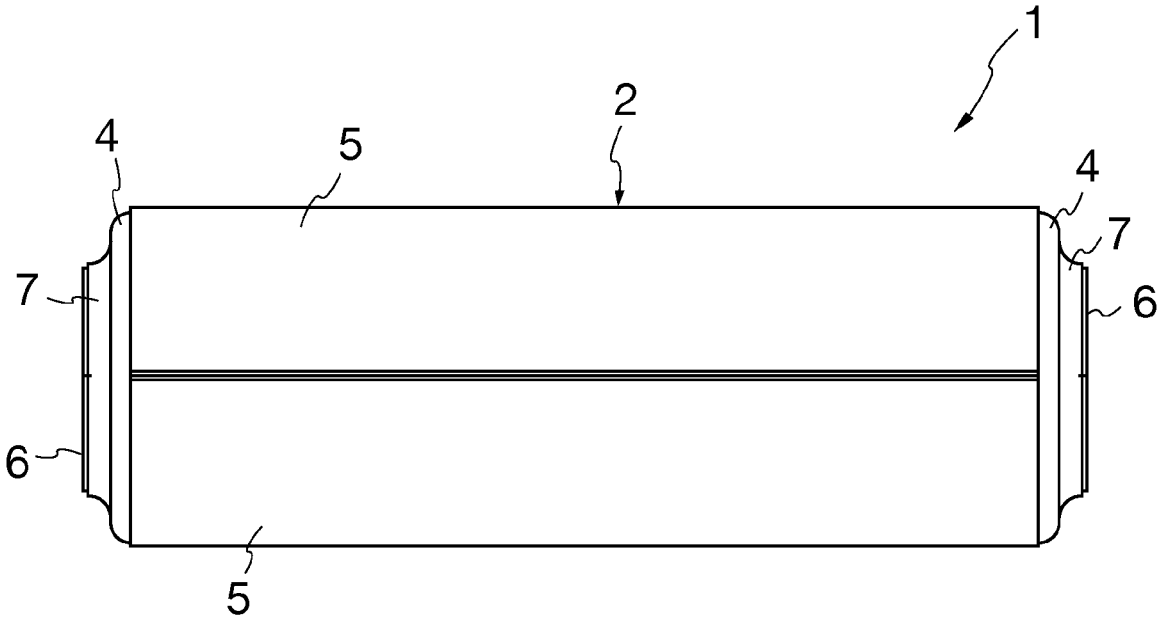
FIG. 3 is a side view of the exhaust muffler corresponding to a direction of view III in FIG. 1.
Figure 4:
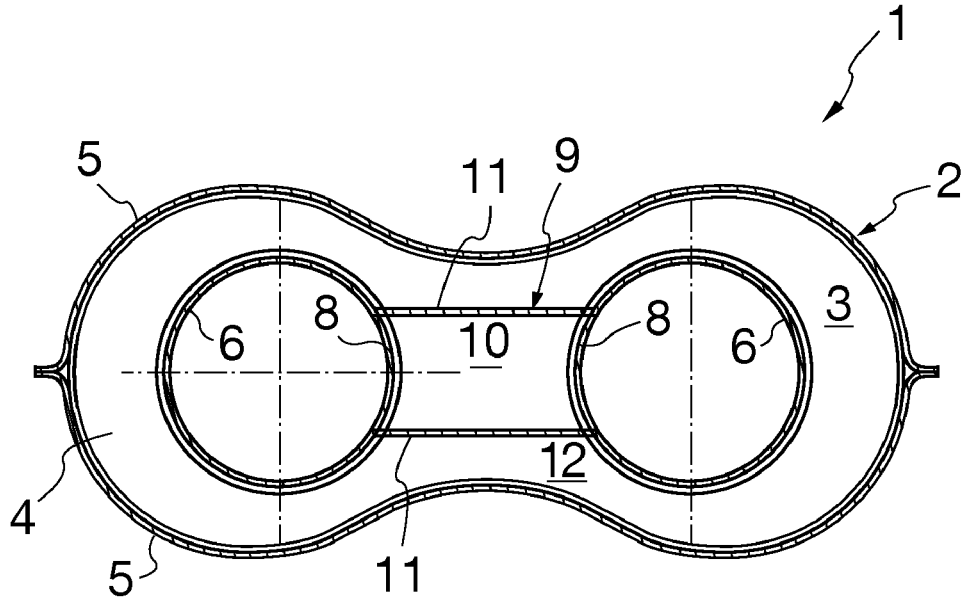
FIG. 4 is a cross section of the exhaust muffler corresponding to section lines IV in FIG. 1.
Figure 5:
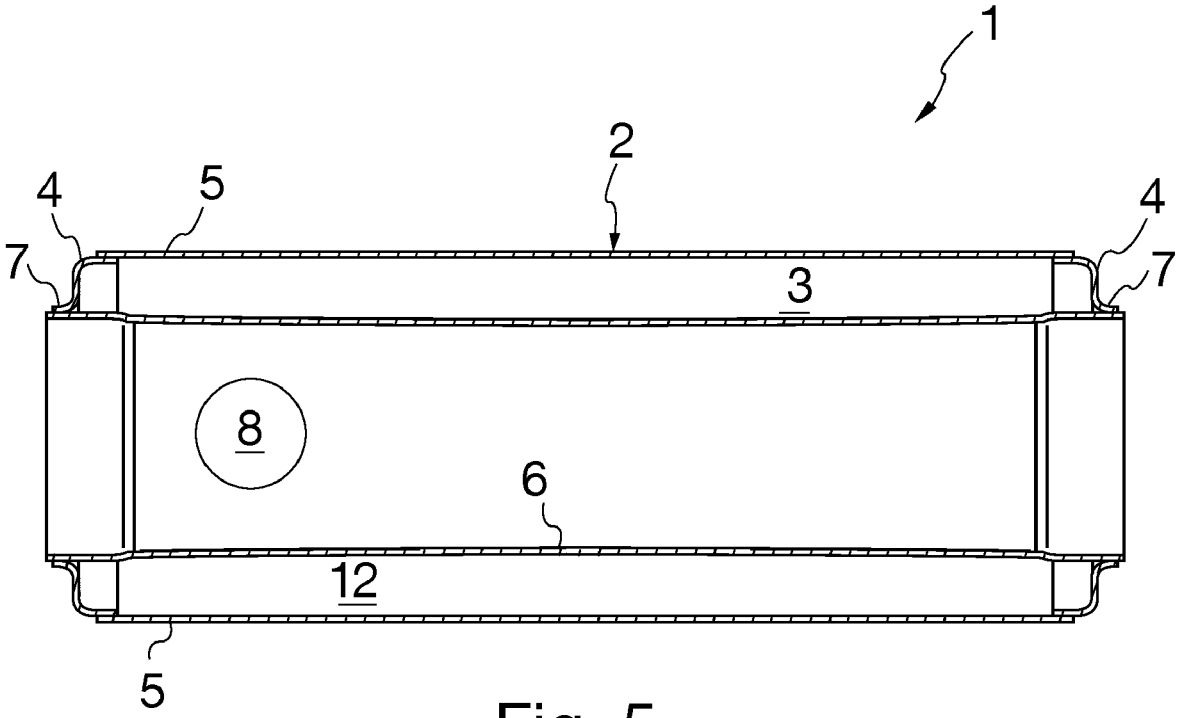
FIG. 5 is a longitudinal section of the exhaust muffler corresponding to section lines V in FIG. 1.
Figure 8:
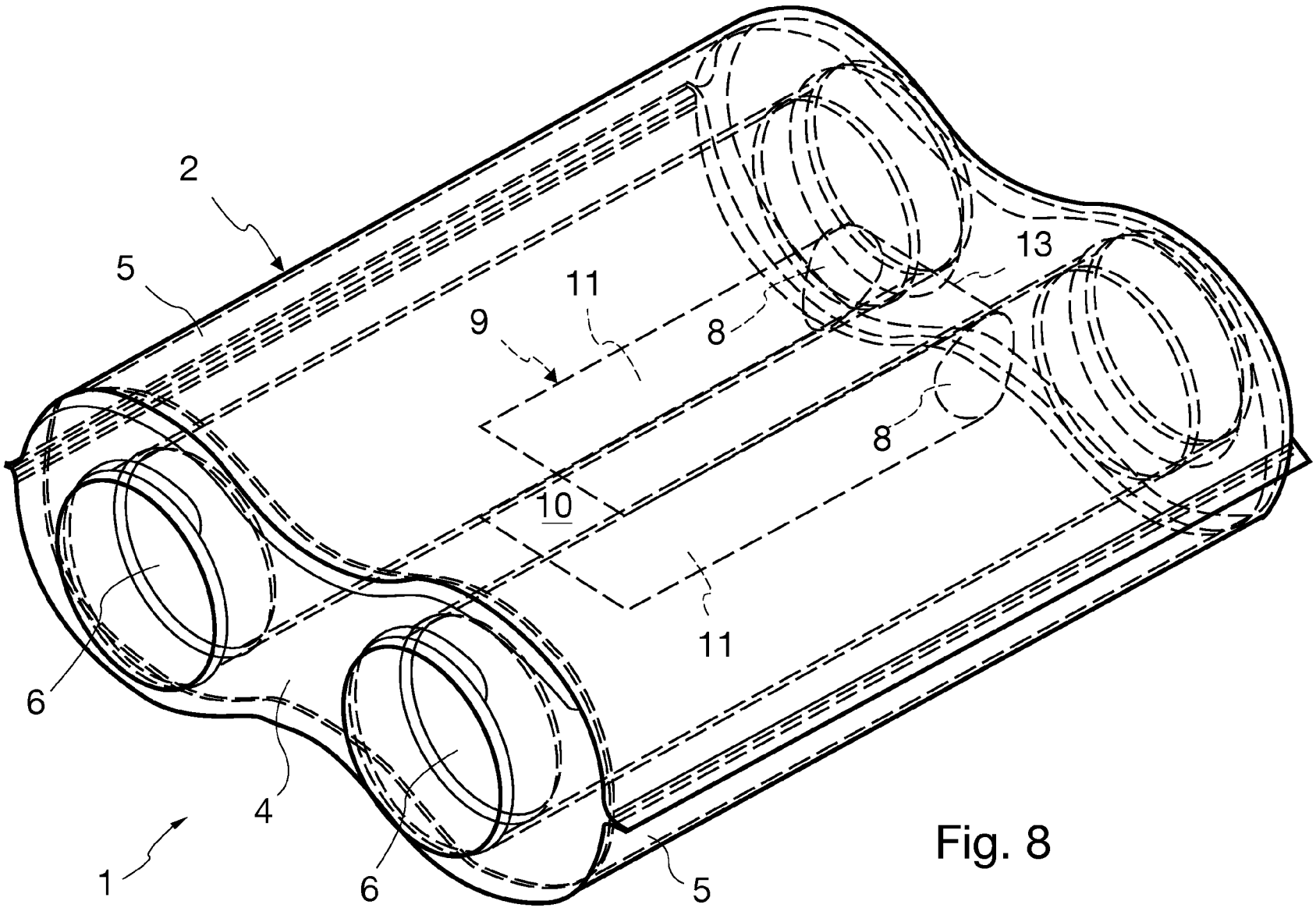
FIG. 8 is a perspective view of the exhaust muffler.

Corresponding to FIGS. 2, 4 and 8, housing 2 may have a cross section in the form of a horizontal eight in the embodiment being shown, i.e., the half shells 5 are outwardly concave. On the one hand, the stability of the housing 2 can be increased by these indentations of the half shells 5. On the other hand, the resonance characteristic of the housing 2 can also be affected hereby in the desired manner. Furthermore, the resonance volume 12 can also be defined hereby for designing the Helmholtz resonator.

Figure 9:
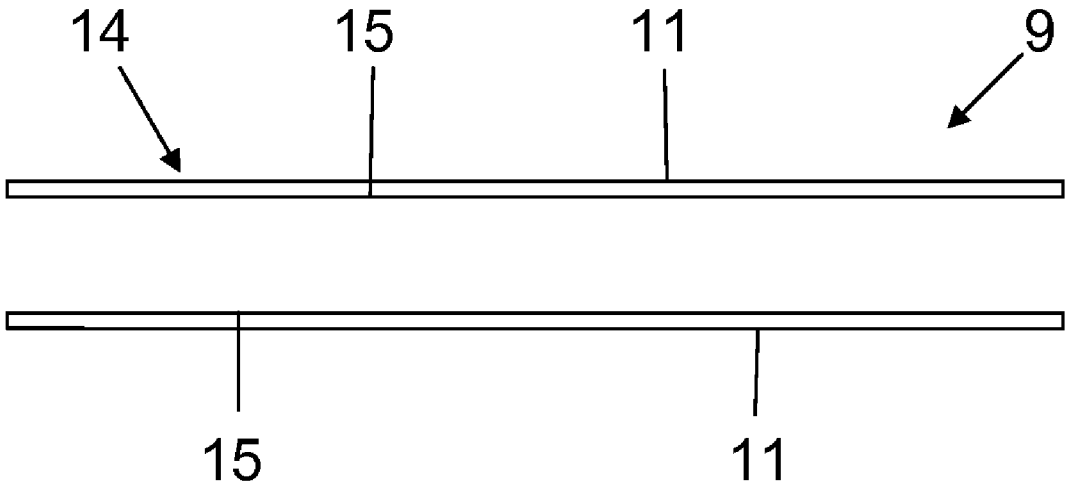
FIG. 9 is a side view of the neck body that is open on both sides to the resonance volume.

Corresponding to the embodiment being shown here, the side openings 8 are provided with a round cross section. Matching this, the transverse wall 13 has a semicircular longitudinal section, as can be recognized, for example, in FIG. 7. The radii of the side openings 8 and of the transverse wall 3 are preferably coordinated with one another. FIG. 9 shows the neck body 9 without the transverse wall 3 such that the neck body 9 is open towards the resonance volume on both sides of the side openings 8.

While specific embodiments of the invention have been shown and described in detail to illustrate the application of the principles of the invention, it will be understood that the invention may be embodied otherwise without departing from such principles.

What is claimed is:

1. An exhaust muffler for an at least partly dual-flow exhaust system of an internal combustion engine, the exhaust muffler comprising:

a housing enclosing a continuous interior space;

two exhaust pipes through which exhaust gas can flow in parallel and which are each led through the interior space and which have each a side opening within the housing, said two exhaust pipes generating resonance;

a neck body connecting the two side openings of the exhaust pipes in a communicating manner to form a Helmholtz resonator with the continuous interior space of the housing, with said interior space of the housing forming a resonance volume, the neck body having two plate-shaped longitudinal walls each in contact with the two exhaust pipes and defining a neck volume, into which the side openings of the exhaust pipes open, the neck volume being open towards the resonance volume, wherein said Helmholtz resonator absorbs said resonance generated by said two exhaust pipes.

2. An exhaust muffler in accordance with claim 1, wherein the neck body has a plate-shaped transverse wall, which defines the neck volume on one side of the side openings, and the neck volume is only open towards the resonance volume on the other side of the side openings.

3. An exhaust muffler in accordance with claim 2, wherein the neck body is formed by a U-shaped sheet metal part with legs forming longitudinal walls and with a base forming the transverse wall, the transverse wall connecting the two legs to one another.

4. An exhaust muffler in accordance with claim 3, wherein the sheet metal part is formed from a single piece of sheet metal.

5. An exhaust muffler in accordance with claim 1, wherein:

the neck body has a plate-shaped transverse wall; and the two side openings are arranged in the area of the transverse wall.

6. An exhaust muffler in accordance with claim 1, wherein the neck volume is open towards the resonance volume on both sides of the side openings.

7. An exhaust muffler in accordance with claim 1, wherein the side openings are located opposite each other in the neck volume.

8. An exhaust muffler in accordance with claim 1, wherein the exhaust pipes are led through the housing in a straight line and in parallel to one another.

9. An exhaust muffler in accordance with claim 1, wherein the housing has a shell type construction.

10. An exhaust muffler in accordance with claim 1, wherein said housing comprises a first half shell portion, a second half shell portion, a first outer wall portion and a second outer wall portion, said first half shell portion being connected to said second half shell portion via said first outer wall portion and said second outer wall portion, said first outer wall portion having a first outer wall portion surface in contact with an ambient environment, said second outer wall portion having a second outer wall portion surface in contact with the ambient environment, said first half shell portion, said second half shell portion, said first outer wall portion and said second outer wall portion defining said continuous interior space, said neck body being located at a space location from said from said first shell portion, said second shell portion, said first outer wall portion and said second wall portion.

11. An exhaust system for an internal combustion engine, the exhaust system comprising:

an internal combustion engine dual-flow exhaust; and an exhaust muffler comprising:

a housing enclosing a continuous interior space;

two exhaust pipes through which exhaust gas can flow, wherein each of said two exhaust pipes forms a flow region with a resonance characteristic based on exhaust gas flow therethrough, each of said two exhaust pipes having an exhaust pipe opening, each of said exhaust pipes being connected to one said dual-flow exhaust, said exhaust pipes extending in parallel through said continuous interior space, each of said exhaust pipes having a side opening within said housing;

a neck body having two plate-shaped longitudinal walls in contact with said two exhaust pipes and defining a neck volume in communication with an interior of said two exhaust pipes via each side opening, said neck body forming a Helmholtz resonator with said continuous interior space of said housing, with said continuous interior space of said housing forming a resonance volume, said neck volume being open towards said resonance volume, said Helmholtz resonator absorbing said resonance in said two exhaust pipes, each said exhaust pipe opening of said two exhaust pipes defining the only exit and entrance of a flow of exhaust gas into and out of said resonance volume.

12. An exhaust system in accordance with claim 11, wherein the neck body has a plate-shaped transverse wall, which defines the neck volume on one side of the side openings, and the neck volume is only open towards the resonance volume on the other side of the side openings.

13. An exhaust system in accordance with claim 12, wherein the neck body is formed by a U-shaped sheet metal part with legs forming longitudinal walls and with a base forming the transverse wall, the transverse wall connecting the two legs to one another.

14. An exhaust system in accordance with claim 13, wherein the sheet metal part is formed from a single piece of sheet metal.

15. An exhaust system in accordance with claim 11, wherein:

the neck body has a plate-shaped transverse wall; and the two side openings are arranged in the area of the transverse wall.

16. An exhaust system in accordance with claim 11, wherein the neck volume is open towards the resonance volume on both sides of the side openings.

17. An exhaust system in accordance with claim 11, wherein the side openings are located opposite each other in the neck volume.

18. An exhaust system in accordance with claim 11, wherein the exhaust pipes are led through the housing in a straight line and in parallel to one another.

19. An exhaust system in accordance with claim 11, wherein the housing has a shell type construction.

20. An exhaust system in accordance with claim 11, wherein said housing comprises a first half shell portion, a second half shell portion, a first outer wall portion and a second outer wall portion, said first half shell portion being connected to said second half shell portion via said first outer wall portion and said second outer wall portion, said first outer wall portion having a first outer wall portion surface in contact with an ambient environment, said second outer wall portion having a second outer wall portion surface in contact with the ambient environment, said first half shell portion, said second half shell portion, said first outer wall portion and said second outer wall portion defining said continuous interior space, said neck body being located at a space location from said from said first shell portion, said second shell portion, said first outer wall portion and said second wall portion.

* * * * *